US005413500A

United States Patent [19]

Tanaka

[11] Patent Number: 5,413,500

[45] Date of Patent: May 9, 1995

[54] TERMINAL CAP AND CAP ATTACHMENT STRUCTURE

[75] Inventor: Tsutomu Tanaka, Yokkaichi, Japan

[73] Assignee: Sumitomo Wiring Systems, Ltd., Yokkaichi, Japan

[21] Appl. No.: 167,037

[22] Filed: Dec. 16, 1993

[30] Foreign Application Priority Data

Dec. 25, 1992 [JP] Japan ..... 4-088982 U

[51] Int. Cl.[6] ..... H01R 13/52

[52] U.S. Cl. ..... 439/521; 439/801

[58] Field of Search ..... 439/519, 521, 522, 202, 439/502, 503, 504, 754, 801, 883

[56] References Cited

U.S. PATENT DOCUMENTS 3,633,154 1/1972 Glantz ..... 439/202
4,572,878 2/1986 Daugherty ..... 439/522
5,169,338 12/1992 Dewar et al. ..... 439/522

FOREIGN PATENT DOCUMENTS 0534646 3/1993 European Pat. Off. ..... 439/522
62-129775 8/1987 Japan .

*Primary Examiner*—Larry I. Schwartz

*Assistant Examiner*—Hien D. Vu

*Attorney, Agent, or Firm*—Sandler Greenblum & Bernstein

[57] ABSTRACT

A pair of engaging projections comprising a first part projecting widthwise and a second part formed by bending the end of this first part to project in the thickness direction is formed opposite each other on the connecting member of the terminal. The terminal cap comprises a fixed member comprising a connector-side member for the terminal and a base-side member for the terminal. The terminal cap also comprises a cover member comprising a first cover part closing the base-side member and a second cover part closing the connector-side member. A connector opening to which is inserted into the connection terminal connecting to the connecting member is provided on the connector-side member. A perimeter wall projecting in the direction reducing the diameter of the connector opening is provided. The first part of the engaging projection of the connecting member inserted to the connector opening engages the perimeter wall. Both sides of the first and second parts of the engaging projections engage the first and third engaging ribs provided on the perimeter wall.

8 Claims, 5 Drawing Sheets

TERMINAL CAP AND CAP ATTACHMENT STRUCTURE

BACKGROUND OF THE INVENTION

1. Field of the Invention

The present invention relates to a terminal cap, and particularly to a terminal cap covering a terminal element connected to the end of a wire to prevent a junction between this terminal element and a connection terminal of an electric appliance from being brought into contact with another component to thereby protect the terminal from moisture, dust, etc., and also to prevent play of the terminal element inside the terminal cap.

2. Description of the Prior Art

Various terminal caps which cover a terminal element connected to the end of a wire to prevent the junction between the terminal element and the connection terminal of the electrical device from contacting another component and to protect it from moisture, dust, etc., have been suggested and utilized commercially.

FIG. 9 illustrates, in an exploded view, one of the prior art terminal caps, reference to which will now be made for the discussion of the prior art. As shown therein, the terminal cap 1 includes a connector-side member 3 and a base-side member 4. The connector-side member 3 is a hollow body opening at the top and bottom thereof as shown and is used to enclose a terminal tag *2a* of a terminal element 2. The base-side member 4 is used to firmly hold a terminal stem *2c* of the terminal element 2 and includes a stem crimp *2b* by which the terminal element 2 is firmly connected with a bared end *9a* of a cable 9. This terminal cap 1 also includes first and second covers 5 and 6 for closing the top openings of the connector-side member 3 and base-side member 4, respectively. Reference numeral 7 represents a terminal connector of an electrical device 8 with which the terminal element 2 is electrically connected.

When the terminal element 2 is to be covered by this terminal cap 1, the terminal tag *2a* of the terminal element 2 is first placed in the connector-side member 3, the terminal stem *2c* and the wire end *9a* are subsequently placed in the base-side member 4, and the second cover 6 is closed. Thereafter, the connector-side membe 3 enclosing the terminal element 2 is placed over the terminal connector 7 from above as seen with a conductor bolt 10 of the terminal connector 7 inserted through a through-hole *2d* in the terminal tag *2a*. The nut 12 is thereafter threaded onto the conductor bolt 10 to tighten the terminal tag *2a* to the terminal connector 7, after which the top opening *3a* of the connector-side member 3 is covered by the first cover 5.

With this terminal cap 1, however, the terminal element can move inside the connector-side member 3 in a lengthwise direction parallel to the direction in which the cable 9 may be pulled as indicated by arrows A and B, a lateral direction perpendicular to the lengthwise direction of the cable 9 as indicated by arrows C and D, and/or in a vertical direction perpendicular to the lengthwise direction of the cable 9 as indicated by arrows E and F, to such an extent as to result in a possible displacement in position of the terminal element 2 relative to the terminal cap 1. With the terminal cap 1 shown in FIG. 9 in particular, there is no restraint applied to vertical movement of the terminal tag *2a* and, therefore, the terminal element 2 is apt to undergo an arbitrary motion considerably in the vertical direction.

When the position of the terminal tag *2a* in the terminal cap 1 shifts due to movement of the terminal element 2, the conductor bolt 10 does align with the through-hole *2d* and it will become difficult to pass the conductor bolt 10 easily and quickly through the through-hole *2d* when the connector-side member 3 is placed over the terminal connector 7. It is therefore necessary for the worker to adjust the position of the terminal element 2 before placing the connector-side member 3 over the terminal connector 2, increasing the complexity of the task and inviting a drop in productivity.

SUMMARY OF THE INVENTION

The present invention is designed to resolve the problems inherent in the conventional terminal cap as described above and has for its object to provide an improved terminal cap of a type in which any arbitrary motion of the terminal element within the terminal cap is minimized.

To this end, the present invention provides a terminal cap comprising a fixed member having an opened top and including a connector-side member for accommodating a connecting member of a terminal element, and a base-side member for accommodating a base of the terminal element, said base having one end of a wire connected thereto; and a cover member comprising a first cover for closing the base-side member, on a second cover for closing the connector-side member. The connector-side member comprises a connector opening to which the mating side terminal connecting with the connecting member is inserted, and a wall member projecting in a direction reducing a diameter of the connector opening, and the connecting member of the terminal element passing through the connector opening and positioned at a bottom side of the connector-side member is engaged by said wall member.

Preferably, an engaging rib engaging the connecting member of the terminal element for positioning the connecting member to the connector opening is provided at the wall member.

The engaging rib may be tapered toward the open edge of the wall member.

If desired, the first cover of the cover member may be connected to the fixed member such that the base-side member can be selectively opened and closed, and the second cover may be integrally formed with the first cover such that the connector-side member can be selectively opened and closed.

The present invention also provides a terminal cap attachment structure for mounting a terminal cap. This attachment structure comprises a connecting member of the terminal element having a pair of engaging projections formed therein, each of said engaging projections including a first part projecting in mutual opposition widthwise to the terminal connecting member, and a second part formed by curving one end of the first part to project in a thickness direction of the connecting member. The terminal cap includes a fixed member having an opened top, said terminal cap including a connector-side member locating the connecting member of the terminal element, and a base-side member locating a base of the terminal element and the end of a wire connected to said base, and a cover member including a first cover for closing the base-side member and a second cover for closing the connector-side member. On the other hand, the connector-side member includes a connector opening to which a mating terminal connecting with the connecting member is inserted, and a wall member projecting in a direction reducing the diameter of the connector opening, and wherein one surface of the first part of the engaging projection of the connecting member inserted to the connector opening engages the wall member, and both sides of the first and second parts of the engaging projection engage the engaging ribs provided on the wall member.

In this attachment structure, preferably, the end of the second parts of the engaging projections engages a detent provided on the terminal of the mating side.

With the terminal cap according to the present invention, the connecting member is held without play inside the connector-side member of the terminal cap because the connecting member of the terminal passed through the connector opening engages the wall member provided on the connector opening of the connector-side member.

In particular, when the engaging rib is provided on the wall member, movement is more positively-prevented because the terminal connecting member is engaged by the wall member and the engaging ribs.

In addition, when the engaging ribs are tapered, the connecting member inserted to the connector opening can be smoothly engaged by the engaging ribs and the wall member.

Also, when the first cover of the cover member is connected to the fixed member such that the base-side member can be opened and closed, and the second cover is connected to the first cover such that the connecting member can be opened and closed, the space required for installation of the terminal cap is reduced because the space for opening the second cover is not necessary.

Again, movement of the terminal in the direction pulling out the wire, side to side, and up or down can be prevented by providing a pair of engaging projections, comprising a first part projecting in mutual opposition widthwise to the terminal connecting member and a second part formed by curving the end of the first part to project in the thickness direction of the connecting member, on the connecting member of the terminal such that one surface of the first part of the engaging projection of the connecting member inserted to the connector opening engages the wall member, and both sides of the first and second parts of the engaging projections engage the engaging ribs provided on the wall member.

If in this case the ends of the second parts of the engaging projections engage the detents provided on the mating terminal, the terminal and terminal cap will not rotate relative to the mating terminal.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Figure 1:
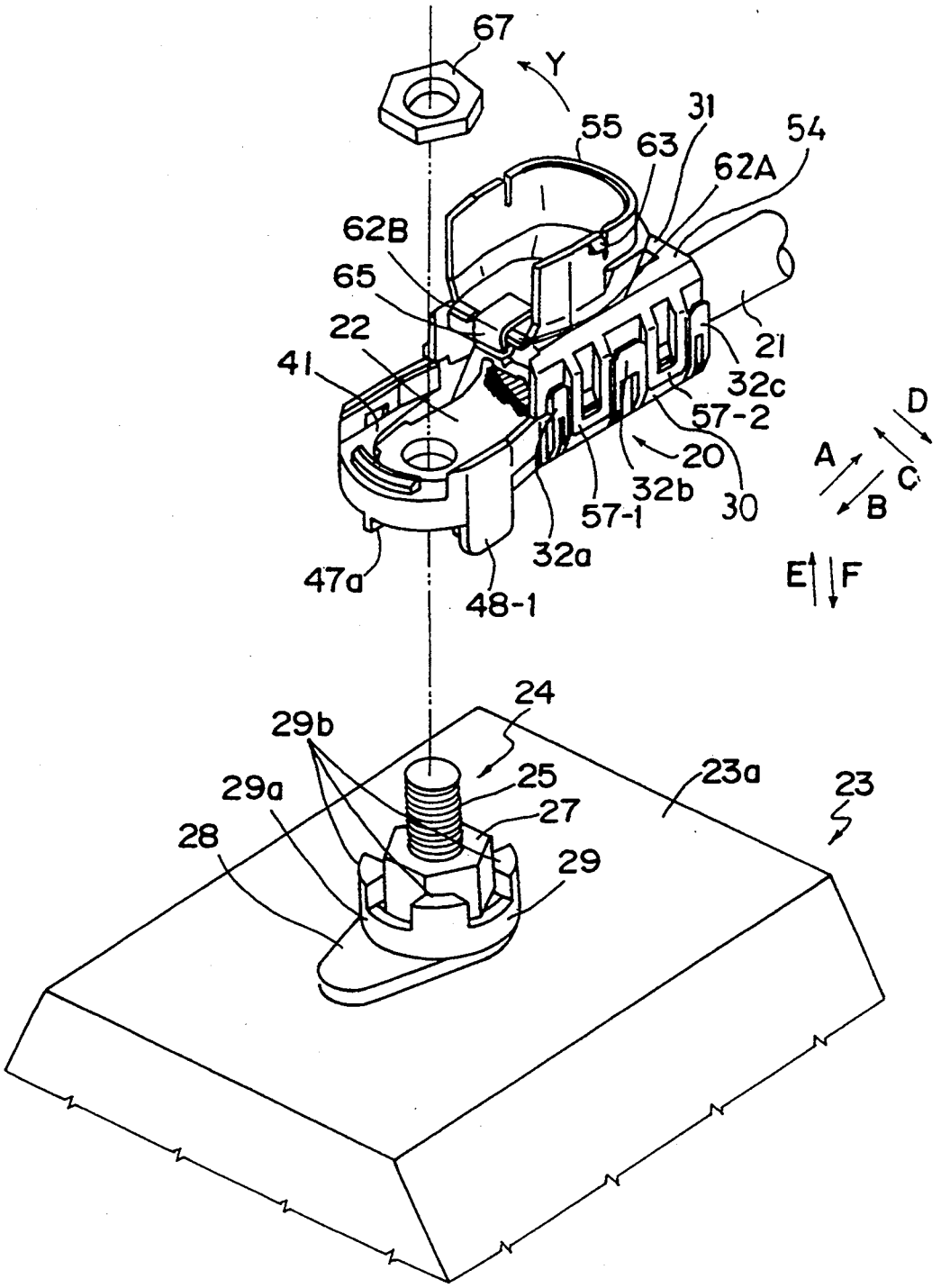
FIG. 1 is a perspective view of a terminal cap according to a preferred embodiment of the present invention, which cap is shown as separated from a terminal connector.

The present invention will now be described in detail based on a preferred embodiment thereof shown in the accompanying drawings.

Referring first to FIG. 1 through FIG. 7, a terminal cap 20 according to the present invention encloses a terminal element 22 secured to a bare end of a cable 21. This terminal element 22 is connected to a connection terminal element 4 of the electrical device 23.

Figure 7:
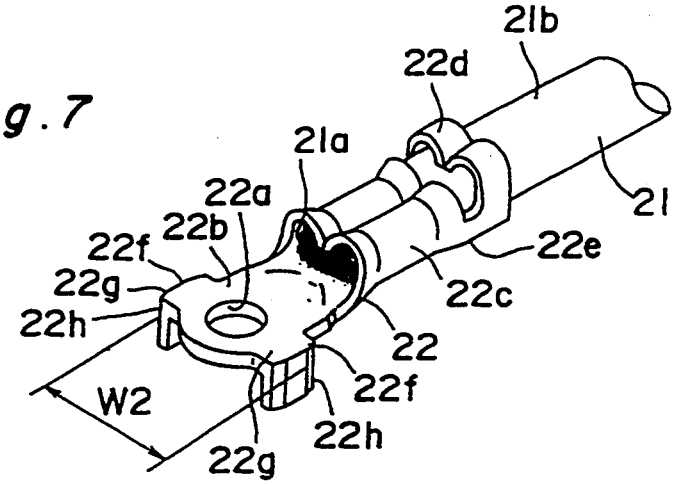
FIG. 7 is a perspective view of the terminal element secured to an electric wire, which can be employed in the practice of the present invention.

As shown in FIG. 7, the cable 21 comprises a plurality of core wires **21*a* bundled together and covered by an electrically insulating sheathing member 21*b*. For connection with the terminal element 22 in a manner which will be described subsequently, the sheathing member 21*b* at one end of the cable 21 is stripped off to expose one end of the wire bundle 21*a***.

The terminal element 22 of one-piece construction is formed by stamping a conductive metal sheet to have a terminal tag **22*b* having a through-hole 21*a* defined therein, and a base 22*e* continued from the terminal tag 22*b*. The base 22*e* includes a wire crimping part 22*c* for crimping the bared end of the wire bundle 21*a* for electrical connection of the cable 21 with the terminal element 22, and a sheath crimping part 22*d* for firmly grasping the sheathing member 21*b* of the cable 21. A pair of engaging projections 22*f* are also integrally formed with the terminal element 22 on respective sides of the terminal tag 22*b* so as to protrude in a direction generally perpendicular to the longitudinal axis of the terminal element 22. Each of these engaging projections 22*f* has a first part 22*g* extending slightly widthwise to the terminal tag 22*b* and a second part 22*h* formed by bending the end of the first part 22*g* in the thickness direction of the terminal tag 22*b***.

The terminal connector 24 projects vertically as shown in FIG. 1 from a housing **23*a* of an electrical device 23, and includes a bolt member 25 connected electrically with an electric circuit installed inside the housing 23. A first nut 27 is threaded onto the bolt member 25 with a washer 28 between the first nut 27 and the top of the housing 23 to tighten and hold a detent member 29. This detent member 29 has detents 29*b* formed integrally therewith and spaced at 90 degree intervals around a ring body 29*a* of the detent member 29**.

The terminal cap 20 of the first embodiment shown in FIGS. 2 through 5 is made from an insulating resin, representing a generally cylindrical shape when a fixed member 30 and a cover member 31 are closed together.

The fixed member 30 is of a generally boat-like configuration opening at 30*f* upwardly and including mutually opposing first and second side walls 30*a* and 30*b* extending in the lengthwise direction, first and second end walls 30*c* and 30*d* connecting both ends of the first and second side walls 30*a* and 30*b*, and a bottom wall 30*e*. The top opening 30*f* of the fixed member 30 is adapted to be closed by the cover member 31. Rectangularly shaped thin flat guide pieces 32*a*, 32*b* and 32*c* are provided on an outer surface of the first wall 30*a* so as to project upwardly above the opening 30*f*, and lock tabs 33*a* and 33*b* are provided between these guide pieces 32*a*, 32*b* and 32*c*. The second wall 30*b* is connected to a first cover part 54 of the cover member 31 by means of thin flexible hinges 35*a* and 35*b*.

The first end wall 30*c* is formed with a semicircular cutout 36 communicated from the opening 30*f* with a flange 36*a* projecting outwardly around this cutout 36.

A portion of the bottom wall 30*e* adjacent to the second end wall 30*d* and remote from the first end wall 30*c* is formed with a connector opening 37 leaving a wall end 3*g* of the bottom wall 30*e*. In the illustrated embodiment, the part where the bottom wall 30*e* is present forms s base-side member 38 for positioning of the base 22*e* of the terminal element 22 and that end of the cable 21 connected to this base 22*e*, and the part where the connector opening 37 is defined is a connector-side member 39 for positioning of the terminal tag 22*b* of the terminal element 22.

The second end wall 30*d* is generally arc-shaped and has a height difference provided between an end face 30*d*-1 adjacent the opening 30*f* and respective end faces 30*a*-1 and 30*b*-1 of the first and second side walls 30*a* and 30*b* adjacent the opening 3O*f*.

At the connector-side member 39 in which the connector opening 37 is formed, a perimeter wall 41 is provided on the inside of the second end wall 30*d* and the first and second side walls 30*a*, 30*b* so as to protrude in a direction reducing the diameter of the connector opening 37. The width of this perimeter wall 41 is approximately constant in the area of the second end wall 30*d*, but becomes gradually smaller in the area of the first and second side walls 30*a* and 30*b* from the second end wall 30*d* to an end 30*g* of the bottom wall 30*e*. The perimeter wall 41 is continued from the end face 30*d*-1 of the second end wall 30*d* with the perimeter wall 41 lying on the same plane as the end face 30*d*-1. The width W1 at the widest part of the perimeter wall 41 is narrower than the width W2 between the engaging projections 22*f* and 22*f* of the terminal element 22.

A substantially arcuate guide projection 44 is integrally formed on an upper surface of the perimeter wall 41 adjacent the opening 30*f* so as to extend substantially parallel to the second end wall 30*d*.

Figure 5:
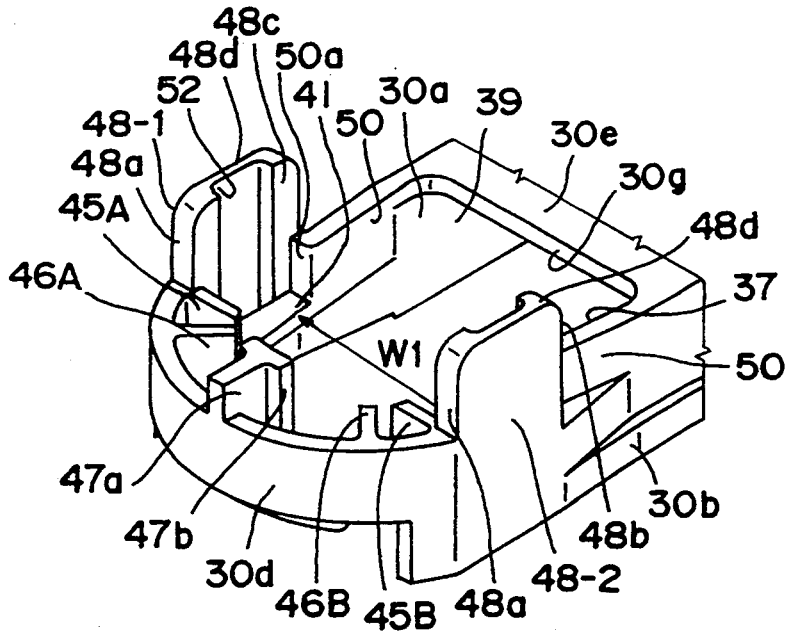
FIG. 5 is a fragmentary perspective view, on an enlarged scale and as viewed from bottom, showing a mount area of the terminal cap.

As shown in FIG. 5, first engaging ribs 45A and 45B are formed at a portion adjacent the bottom wall 30*e* where the first and second side walls 30*a* and 30*b* meet the second end wall 30*d*. These first engaging ribs 45A and 45B are in the form of rectangular flat members extending perpendicular to the first and second side walls 30*a* and 30*b* and the perimeter wall 41.

Also provided on the perimeter wall 41 near the first engaging ribs 45A and 45B are reinforcing ribs 46A and 46B of approximately the same shape as those of the first engaging ribs 45A and 45B.

A second engaging rib 47 is also provided on the perimeter wall 41 at a position corresponding to an end of the second end wall 30*d*. This second engaging rib 47 comprises a first part 47*a* lying perpendicular to an inner face of that end of the second end wall 30*d*, and a second part 47*b* lying perpendicular to the first part 47*a*.

Protective arms 48-1 and 48-2 extending toward the bottom wall 30*e* and having a width greater than that of the engaging projections 22*f* and 22*f* of the terminal element 22 are provided where the first and second side walls 30*a* and 30*b* meet the second end wall 30*d*. Side faces 48*a* of the protective arms 48-1 and 48-2 adjacent the second end wall 30*d* are positioned on approximately the same plane as these first engaging ribs 45A and 45B.

Respective portions of the first and second side walls 30*a* and 30*b* adjacent the protective arms 48-1 and 48-2 on one side adjacent the first end wall 30*c* are inwardly curved as indicated by 50. These curved portions 50 have respective end faces adjacent the second end wall 30*d* lying on the same plane as the side face 48*b* of the protective arm adjacent the first end wall 30*c* so as to form a third engaging rib 50*a* that projects in a direction reducing the diameter of the connector opening 37.

A channel 52 having a rectangular cross-section is formed at an inside face 48*c* of each of the protective arms 48-1 and 48-2 so as to extend from the end 48*d* past the perimeter wall 41 and towards the opening 30*f* side. Respective ends of these channels 51 adjacent the opening 30*f* are utilized as locking recesses 52*a* in which the locking tabs 63 provided on the second cover part 55 of the cover member 31 are engageable, as will be described below.

The cover member 31 comprises a first cover part 54 and a second cover part 55 connected in the lengthwise direction of the cable 21 by means of a snap mechanism 53.

Figure 4:
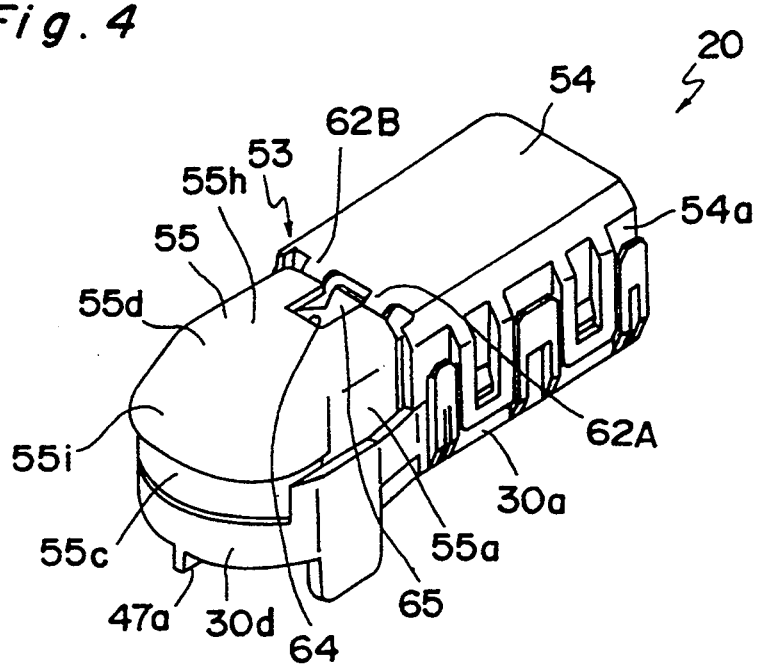
FIG. 4 is a perspective view of the terminal cap in a completely closed position.

The first cover part 54 includes first and second side walls 54*a* and 54*b* extending lengthwise and facing with each other, an end wall 54*c* connecting respective ends of the first and second side walls 54*a* and 54*b* together, and a top wall 54*d* opening at 54*e* downwardly as viewed in FIG. 4, and the side opposite the end wall 54*c* is defined by an open end 54*f*.

Locking arms 57-1 and 57-2 having respective lock holes 57*a* defined therein are provided on the first side wall 54*a* so as to project outwardly from the opening 54*e* at a predetermined interval. The second side wall 54*b* is contiguous to the second wall 30*b* of the fixed member 30 via the hinges 35*a* and 35*b*.

A semicircular cutout 58 is provided at the end wall 54*c* with a flange 58*a* projecting outwardly from around the perimeter in a manner similar to the semicircular cutout 36 in the second end wall 30*d* of the fixed member 30.

A generally inverted U-shaped arch 60 is provided inside the top wall 54*d*, and a connecting member 61 is provided at the opening 54*e*.

The second cover part 55 is of a generally boat-like configuration opening downwardly so as to confront the opening 30*f* in the fixed member 30 and includes first and second side walls 55*a* and 55*b* extending lengthwise and facing towards each other, an end wall 55*c* connecting respective ends of the first and second side walls 55*a* and 55*b* together, and a top wall 55*d*. This second cover part 55 opens downwardly as viewed in FIG. 1, the opening consisting of a first opening 55*f*, corresponding in position to the connector opening 37, and a second opening 55*g* defined at an area corresponding to the first cover part 54.

The spacing between the first and second side walls 55*a* and 55*b* is chosen to be of a value smaller than the spacing between the first and second side walls 30*a* and 30*b* of the fixed member 30. In addition, locking tabs 63 engageable in the respective locking recesses 52*a* of the fixed member 30 are formed in the first and second side walls 55*a* and 55*b*.

The end wall 55*c* forms an arc of a curvature approximately matching that of the second end wall 30*d* of the fixed member 30.

As shown in FIG. 4, the top wall 55*d* in the first cover part 54 has a flat region 55*h*, and an area between this flat region 55*h* and the end wall 55*c* is connected by a curved face 55*i* which has a predetermined slope, the edge of which extends slightly beyond the end of the end wall 55*c*.

The top wall 54*d* of the first cover part 54 and the top wall 55*d* of the second cover part 55 are connected by means of a pair of hinges 62A and 62B formed from a thin-walled member with a gap defined therebetween in the widthwise direction.

A rectangular cutout 64 is formed in the second cover part 55 between the connecting parts of the hinges 62A, and 62B contiguous to one end of an L-shaped member 65, which bends flexibly towards the cutout 64 in the end wall 55*c*. The other end of this L-shaped member 65 is contiguous to the connecting member 61 of the first cover part 54.

Figure 3:
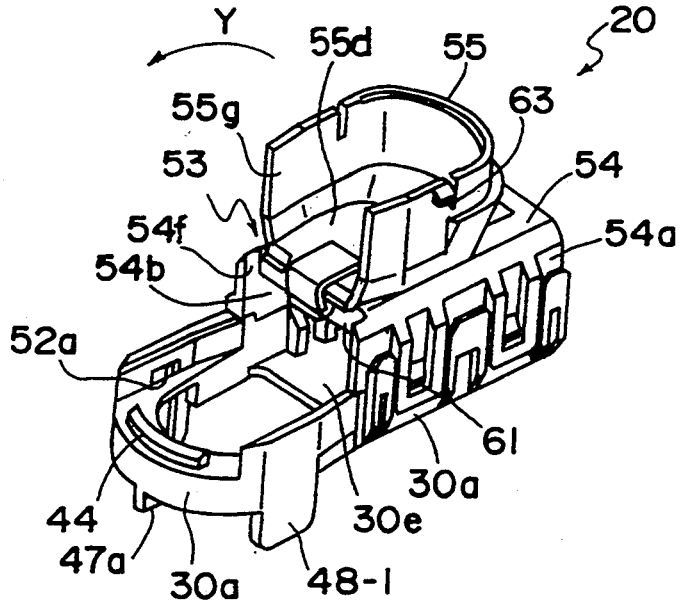
FIG. 3 is a perspective view of the terminal cap in a half-closed position.

In this illustrated embodiment, the first cover part 54 and the second cover part 55 are connected by the snap mechanism 53 comprising the hinges 62A and 62B and the L-.shaped member 65 such that the first cover part 54 can be selectively pivoted with a moderate touch between an open position shown in FIG. 3 and a closed position shown in FIG. 4.

The terminal cap 20 according to the present invention so constructed is fitted to the terminal element 22 to enclose the latter will now be described.

Figure 2:
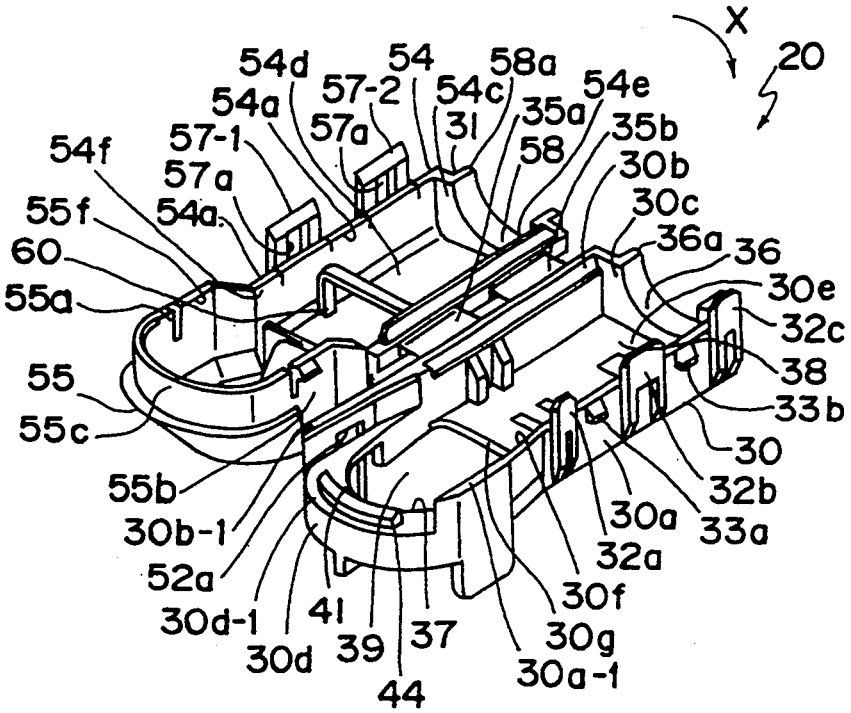
FIG. 2 is a perspective view of the terminal cap in a full open position.

Assuming that the terminal element 22 is in such a condition as shown in FIG. 2 with the cover member 31 swung to the opened position, the terminal element 22 connected to the cable 21 is passed to the connector opening 37 from the top as viewed in FIG. 2. At this time, because the width W1 of the perimeter wall 41 is less than the width W2 in the area of the engaging projections 22*f* of the terminal element 22, the terminal element 22 is inserted to the connector opening 37 such that the engaging projections 22*f* and 22*f* are positioned in the length-wise direction of the perimeter wall 41.

Figure 6:
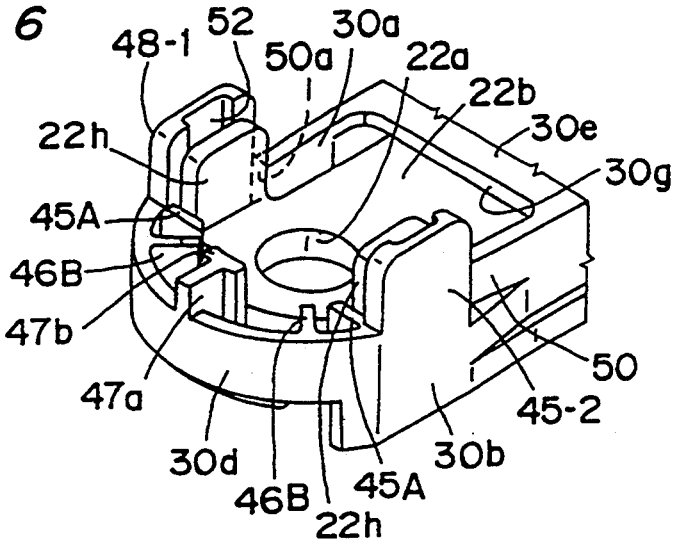
FIG. 6 is a view similar to FIG. 5, with a terminal element inserted therein.

After the terminal cap 20 has been turned relative to the terminal element 22 to position the engaging projections 22*f* of the terminal element 22 to align with the widthwise direction of the perimeter wall 41, the terminal cap 20 is moved in a direction along which the terminal element 22 can be pulled from the connector opening 37. By so doing, as shown in FIG. 6, the engaging projections 22*f* of the terminal element 22 are positioned inside the protective arms 48-1 and 48-2. In other words, the top of the first part 22*g* of the engaging projections 22*f* of the terminal element 22 is engaged against the bottom of the perimeter wall 41, i.e., in contact with the face on the bottom wall 30*e* side, and both of the first and second parts 22*g* and 22*h* of the engaging projections 22*f* are engaged by the first and third engaging ribs 45 and 50*a*. In this position, the terminal tag 22*b* of the terminal element 22 is positioned at the connector-side member 39 of the fixed member 30, and the engaging projections 22*f* are positioned at the base-side member 38.

Next, the first cover part 54 is rotated relative to the fixed member 30 about the hinges 35*a* and 35*b* as indicated by the arrow X in FIG. 1 to cover the base-side member 38. The lock tabs 33*a* and 33*b* are then engaged in the lock holes 57*a* of the locking arms 57-1 and 57-2, and the first cover part 54 and base-side member 38 are thus fastened together as shown in FIG. 3. The lock holes 57*a* and the lock tabs 33 can be positively engaged at this time because the locking arms 57 are guided by the space between the guide pieces 32*a* to 32*c*. In addition, the second cover part 55 is opened back over the first cover part 54, which is closed over the base-side member 38 as shown in FIG. 3, and because the second cover part 55 is not positioned at the side of the fixed member 30, the amount of space required for mounting is reduced that much.

In this state, the cutouts 36 and 58 formed in the first end wall 30*c* of the fixed member 30 and the end wall 54*c* of the first cover part 54 form an electric cable insertion hole through which the cable 21 is conductive from inside the base-side member 38 to the outside, and the flanges 36*a* and 58*a* form a cylindrical passage through which the cable extends outwardly from the terminal cap 20.

As described above, when the base-side member 38 of the fixed member 30 is closed by the first cover part 54, play in the direction as indicated by arrows A and B in FIG. 1 is restricted by engagement of the engaging projections 22*f* and 22*f* and the first and third engaging ribs 45 and 50*a*. In addition, lateral play perpendicular to the direction as indicated by arrows C and D in FIG. 1 is restricted by contact between the second part 21*h* of the engaging projections 22*f* and 22*f* and the inside face 48*c* of the protective arms 48. Play in the vertical direction of the terminal element 22 as indicated by arrows E and F in FIG. 1 is restricted by engagement of the first part 22*g* of the engaging projections and the perimeter wall 41. Thus, in the illustrated embodiment the terminal element 22 is held firmly positioned to the terminal cap 20, and the position of the through-hole 22*a* in the terminal tag 22*b* of the terminal element 22 is held at a predetermined position in the connector opening 37.

Thereafter, the terminal cap 20 housing the terminal element 22 in the manner described hereinbefore is placed over the terminal connector 24 with the bolt member 25 passing through the through-hole 22*a* in the terminal tag 22*b*. At this time, the terminal tag 22*b* is held positioned substantially immovably in the terminal element 22 as described above, and the worker can thus reliably pass the bolt member 25 through the through-hole 22*a* by simply putting the terminal cap 20 over the mating terminal connector 24 without adjusting the position of the terminal element 22 to the terminal cap 20. Also, because the second parts 22*h* and 22*h* of the engaging projections 22*f* and 22*f* are positioned between the detents 29*b* of the detent member 29 when the terminal cap 20 covers the terminal connector 24, the terminal cap 20 and terminal element 22 will not turn relative to the terminal connector 24.

The second nut 67 is then threaded onto the bolt member 25, and the terminal tag 22*b* of the terminal element 22 is fastened firmly to the bolt member 25. The second cover part 55 is also pivoted in the direction of arrow Y to the closed position. At this time, the first and second side walls 55*a* and 55*b* of the second cover part 55 are inserted to the inside of the first and second side walls 30*a* and 30*b* of the fixed member 30, the locking tabs 63 engage the locking recesses 52*a*, and the second cover part 55 is thus fastened to the fixed member 30.

The connecting members of the terminal element 22 and connector terminal element 22 can be prevented from contacting other parts, and the terminal element 22 can be protected against water, dust, etc., because the terminal element 22 covered by the terminal cap 20 is connected to the terminal connector 24.

Figure 8:
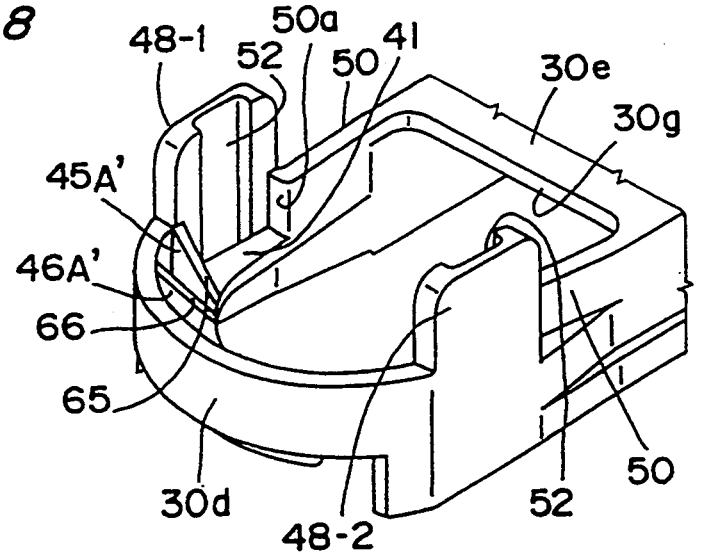
FIG. 8 is a view similar to FIG. 5, showing a modification of the present invention.
Figure 9:
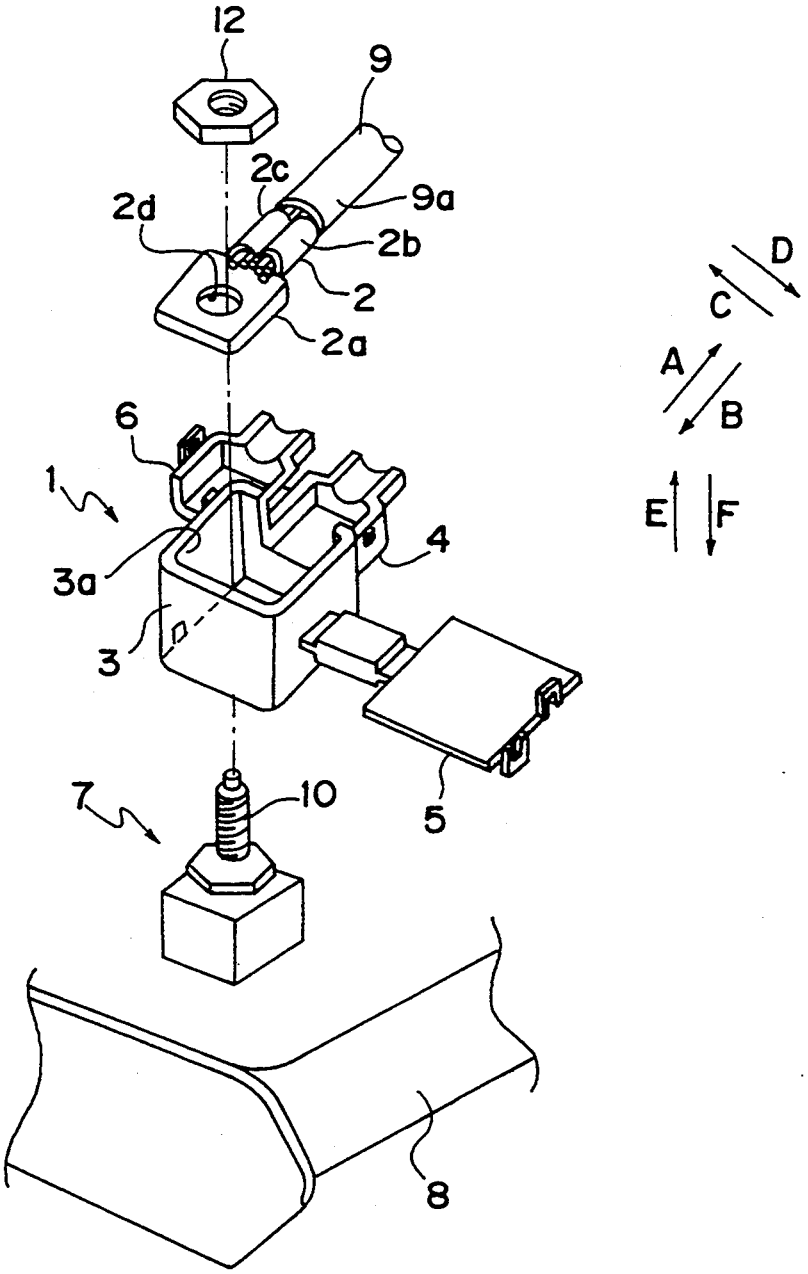
Fig. 9 PRIOR ART
FIG. 9 is an exploded view of the prior art terminal cap.

The terminal cap referred to above may be modified as shown in FIG. 8. More specifically, the terminal cap shown therein has first engaging ribs 45A′ and 45B′ and reinforcing ribs 46A′ and 46B′ formed on the perimeter wall 41 so as to represent a tapered shape having tapers 65 and 66 that slope from the second end wall 30*d* towards the inside edge of the perimeter wall 41. In this modified terminal cap, the second engaging rib 47 employed in the foregoing embodiment is dispensed with.

Because of this configuration as shown in FIG. 8, if the terminal element 22 inserted in the connector opening 37 is moved in the direction removing it from the connector opening 37, the engaging projections 22*f* of the terminal element 2 are guided by the tapers 65 and 66 and are smoothly engaged by perimeter wall 41 and the first engaging ribs 45A′ and 45B′ and the third engaging rib 50*a*.

As is clear from the above description, movement of the terminal can be prevented with a terminal cap according to the present invention because a connector opening to which the mating terminal connecting with the terminal connector and a perimeter wall projecting in the direction reducing the diameter of the connector opening are provided in the connector-side member locating the terminal connector, the engaging projections of the connecting member inserted to the connector opening engage the perimeter wall, and both sides of the engaging projections engage the engaging ribs provided on the perimeter wall.

Therefore, because the terminal element is positively held positioned to the connector-side member by means of a terminal cap according to the present invention, the mating terminal element and the connector terminal can be positively connected by inserting the mating terminal element to this connector-side member. For example, if a through-hole is provided in the connector terminal and the mating terminal element has a bolt member, and when the connector-side member covers the mating terminal, the bolt member can be positively passed through the through-hole and there is no need for the worker to adjust the position of the connector terminal inside the terminal cap. Thus, with the terminal cap according to the present invention, mounting to the terminal is simple, and productivity can be improved.

Furthermore, when the engaging ribs have a tapered shape, the connector terminal can be smoothly engaged with the perimeter wall and the engaging ribs if the terminal cap is moved in the direction pulling the wire out after the connector terminal is inserted to the connector opening.

In addition, the space for opening the second cover part is not necessary and the space required for the installation task can be reduced because when the second cover part can fold over the first cover part when it is open if the first cover part is connected to the fixed member in a manner enabling the base-side member to open and close, and the second cover part is connected to the first cover part in a manner enabling the connecting member to be opened and closed.

In addition, rotation of the terminal cap and terminal element to the mating connector terminal can be prevented, and various other benefits obtained, if the engaging projections comprise a first part projecting in the widthwise direction of the connector terminal and a second part, which is formed by bending the end of the first part, projecting in the thickness direction of the connector terminal, and the end of this second part engages detents provided on the connector terminal.

Although the present invention has been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A terminal cap comprising:

a fixed member having an opened top and including a connector-side member for accommodating a connecting member of a terminal element, and a base-side member for accommodating a base of the terminal element, said base having one end of a wire connected thereto; and a cover member comprising a first cover portion for closing the base-side member, and a second cover portion for closing the connector-side member;

wherein the connector-side member comprises a connector opening in which a terminal connector of an electrical device is inserted for engaging with the connecting member, and a wall member projecting in a direction reducing a diameter of the connector opening, and wherein the connecting member of the terminal element positioned at the connector opening and positioned at a bottom side of the connector-side member is engaged by said wall member wherein the first cover portion of the cover member is connected to the fixed member such that first cover portion can be selectively opened and closed, and the second cover portion is connected to the first cover portion such that the second cover portion can be opened and closed independently of the first cover portion.

2. A terminal cap according to claim 1 wherein an engaging rib engaging the connecting member of the terminal element for positioning the connecting member to the connector opening is provided at the wall member.

3. A terminal cap according to claim 1, wherein said engaging rib is tapered toward the open edge of the wall member.

4. A terminal cap according to claim 1 wherein the second cover portion is integrally molded contiguous to the first cover portion.

5. A terminal cap attachment structure for mounting a terminal cap on a terminal element which comprises:

a connecting member of the terminal element having a pair of engaging projections formed therein, each of said engaging projections including a first part projecting in mutual opposition widthwise to the connecting member, and a second part formed by curving one end of the first part to project in a thickness direction of the connecting member;

said terminal cap comprising a fixed member having an opened top, said terminal cap including a connector-side member locating the connecting member of the terminal element, and a base-side member locating a base of the terminal element and having one end of a wire connected to said base, and a cover member including a first cover for closing the base-side member and a second cover for closing the connector-side member;

wherein the connector-side member comprises a connector opening in which a terminal connector of an electrical device is inserted for engaging with the connecting member, and a wall member projecting in a direction reducing the diameter of the connector opening having an interior surface facing the connector opening and having engaging ribs on the interior thereof, and wherein one surface of the first part of said pair of engaging projections of the connecting member positioned at the connector opening engages the wall member, and both sides of the first and second parts of the engaging projections engage the engaging ribs provided on the wall member.

6. A terminal cap attachment structure as claimed in claim 5, wherein an end of the second part of said pair of engaging projections engages a detent provided on the terminal connector.

7. A terminal cap attachment structure of claim 6 wherein said terminal connector has a base portion and said detent is formed in a detent member surrounding the base portion.

8. A terminal cap attachment structure of claim 7 wherein said detent member is generally annular and is secured to the base portion of the terminal connector by a nut.

* * * * *

UNITED STATES PATENT AND TRADEMARK OFFICE

CERTIFICATE OF CORRECTION

PATENT NO. : 5,413,500

DATED : May 9, 1995

INVENTOR(S) : T. TANAKA

It is certified that error appears in the above-indentified patent and that said Letters Patent is hereby corrected as shown below:

At column 1, line 48, change "membe" to ---member---.
At column 2, line 31, change "on" to ---and---.
At column 5, line 26, change "forms s" to ---forms---.
At column 5, line 36, change "30f" to ---30f---.
At column 9, line 6, change "22" to ---24---.
At column 9, line 24, change "2" to ---22---.
At column 9, line 64, delete "when".

Signed and Sealed this

Thirtieth Day of July, 1996

Bruce Lehman

*Attest:*

BRUCE LEHMAN

*Attesting Officer*

*Commissioner of Patents and Trademarks*